United States Patent [19]

Schaible

[11] Patent Number: 4,532,786

[45] Date of Patent: Aug. 6, 1985

[54] METHOD FOR MANUFACTURING A VEHICLE WHEEL

[75] Inventor: Walter Schaible, Korntal, Fed. Rep. of Germany

[73] Assignee: Dr. Ing. h.c.F. Porsche A.G., Fed. Rep. of Germany

[21] Appl. No.: 545,680

[22] Filed: Oct. 26, 1983

[30] Foreign Application Priority Data

Oct. 27, 1982 [DE] Fed. Rep. of Germany ..... 3239675

[51] Int. Cl.[3] ..... B21H 1/04

[52] U.S. Cl. ..... 72/68; 72/71; 72/83; 29/159.01

[58] Field of Search ..... 72/67, 68, 69, 70, 71, 72/82, 83; 29/159 R, 159.1, 159.01

[56] References Cited

U.S. PATENT DOCUMENTS 2,075,294 3/1937 Le Jeune ..... 29/159 R

FOREIGN PATENT DOCUMENTS 1908465 9/1970 Fed. Rep. of Germany .
1752895 11/1970 Fed. Rep. of Germany ... 29/159.01
8028246 10/1982 Fed. Rep. of Germany .
1186248 2/1959 France ..... 72/68

*Primary Examiner*—Lowell A. Larson
*Attorney, Agent, or Firm*—Craig and Burns

[57] ABSTRACT

A method for the manufacture of a vehicle wheel from light metal with an asymmetric rim base, which is made from a plate or disk by rolling, pressing, cutting and aperture-forming steps. In order for the wheel to be formed in a simple manner without costly manufacturing steps, the edge of the disk or plate is angularly bent, according to the method of the present invention, prior to splitting and the subsequent forming of the rim base. This is necessary in order for the rim base to be formed with different lengths of legs having the same thickness.

4 Claims, 6 Drawing Figures

METHOD FOR MANUFACTURING A VEHICLE WHEEL

FIELD OF THE INVENTION

The present invention relates to a method for manufacturing a one-piece vehicle wheel of light metal having a hub part and a tire rim for an inflatable tire.

BACKGROUND OF THE INVENTION

A method for manufacturing a vehicle wheel from a light metal plate or disk is known from the German Auslegeschrift No. 10 68 654. This plate or disk is brought by forging and pressing into the shape of a dish with a thickened outer edge portion which is preformed angularly shaped. The preformed edge is then formed by a rolling-pressing step into a rim base with legs of different length. For the manufacture of the edge constructed in a special manner, additional costly operating steps are neccessary with this prior art method, such as forging and pressing, to which the light metal plate or disk is exposed. These operating steps are very costly with light metal and are realizable only after heating the same to the melting temperature.

SUMMARY AND OBJECTS OF THE INVENTION

It is the object of the present invention to simplify the manufacture of a one-piece vehicle wheel from a light metal plate or disk.

The underlying problems are solved according to the present invention in that the edge, in a first operating step, receives an obliquely outwardly directed outer edge part and in a subsequent further operating step the edge is split in a longitudinal center plane of the wheel into two ring-shaped parts of idential thickness, with one of the parts having a greater accumulation of material at its distal end. These ring-shaped parts are then lengthened by a rolling-pressing operation into a rim base with legs of different lengths and of approximately identical thickness.

One of the advantages primarily achieved with the present invention includes the forming of the rim base with different lengths of legs and with identical wall thickness. This becomes possible in a simple manner either by an operating step carried out on the plate or the formed wheel dish.

This operating step includes a simple bending of the outermost edge section of the plate out of its plane and of a central splitting of the edge in a plane parallel to the plane extending centrally the wheel dish. A unilateral larger material accumulation is produced for a leg portion of greater length by the angular bending and the material prior to when the splitting occurs such that the longer leg of the rim base is formed from the portion with the greater material proportion and the shorter leg of the rim base is formed from the portion with the smaller material proportion.

These and other objects, features and advantages of the present invention will become more apparent from the following description when taken in connection with the accompanying drawings which shows, for purposes of illustration only, the essential operating steps for the manufacture of a one-piece light metal vehicle wheel in accordance with the method of the present invention, and wherein:

DETAILED DESCRIPTION OF THE PREFERRED EMBODIMENT

Figure 1:
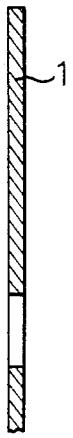
FIG. 1 is a partial cross-sectional view through a light metal plate or disk for the manufacture of a vehicle wheel in accordance with the present invention in the starting condition.
Figure 2:
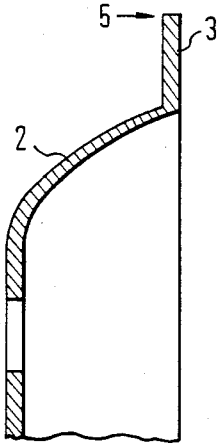
FIG. 2 is a partial cross-sectional view illustrating a preformed rim dish with an edge.
Figure 3:
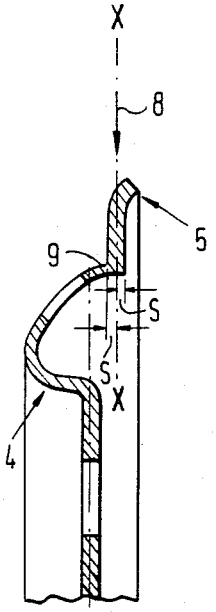
FIG. 3 is a partial cross-sectional view of a completely formed wheel dish with an angularly bent outer edge according to the present invention.
Figure 4:
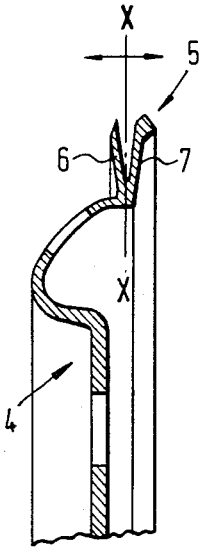
FIG. 4 is a schematic partial cross-sectional view of the centrally split edge during the splitting operation in accordance with the present invention.
Figure 5:
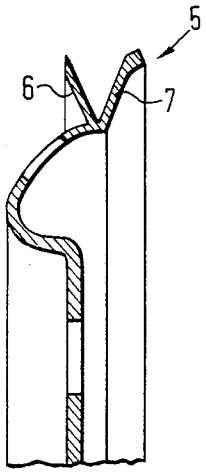
FIG. 5 is a partial cross-sectional view through the wheel dish with a completed cut-open edge.
Figure 6:
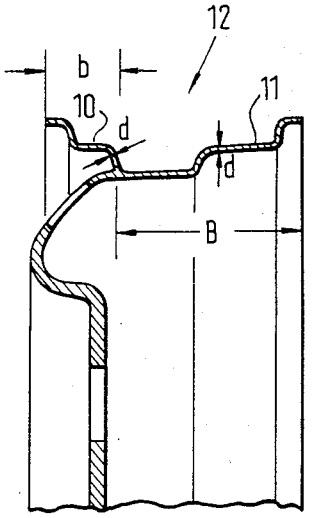
FIG. 6 is a partial cross-sectional view through the vehicle wheel with a completely formed wheel base.

Referring now to the drawing wherein like reference numerals are used throughout the various views to designate like parts, a wheel dish 2 with an edge 3 (FIG. 2) is preformed in a pressing operation from a light metal disk or plate 1, illustrated in FIG. 1. In a subsequent operating step according to FIG. 3, the wheel dish 2 is brought into its final shape generally designated by reference numeral 4. At the same time, the outer edge portion 5 is angularly bent so that it projects obliquely outwardly out of the longitudinal center plane X—X of the wheel. In a further operating step illustrated in FIGS. 4 and 5, the edge 3 is split open in the direction of arrow 8 in the longitudinal center plane X—X of the wheel. This takes place preferably by means of a cutting roller which effects a V-shaped splitting of the edge 5 up to the boundary 9 of the wheel dish 4 into two equally thick annular ring-shaped parts 6 and 7. After this splitting operation, the one annular ring part 7 has a greater material accumulation at its distal end than the other annular ring part 6. These parts 6 and 7 are subsequently elongated by a rolling-pressing operation into the legs 10 and 11 which then form the completed rim base. The rim base includes a leg 10 of smaller length b and a leg 11 of greater length B. Both legs 10 and 11 can thus be manufactured of identical thickness d by reason of the bent end forming a differing material accumulation at the distal end of part 7 notwithstanding different leg lengths b and B.

The operating step of the angular bending can take place in any phase of the manufacturing operation prior to the splitting and rolling-pressing step. Thus, it is possible to carry out the angular bending either during the manufacture of the plate or disk itself or during the forming of the wheel dish according to FIG. 3.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A method for manufacturing a one-piece vehicle wheel from light metal in which the wheel includes a hub portion and a rim portion, the method including pressing a wheel dish from a disk and forming a rim base from an edge of the disk, the forming of the rim base including the steps of bending the edge obliquely outwardly from a longitudinal plane of the wheel to form an outer edge portion, splitting the outer edge portion along the longitudinal plane of the wheel into two annular ring parts of substantially similar thickness with one of the ring parts having a larger accumulation of material associated with the distal end thereof, and extending the annular ring parts by a rolling-pressing operation into a rim base having legs of different lengths and of generally equal thickness.

2. A method according to claim 1, wherein the bending operation forming the outwardly directed outer edge portion occurs subsequent to an intermediate step of forming the finished hub portion.

3. A method according to claim 1, wherein the bending operation forming the outwardly directed outer edge portion occurs during the manufacture of the disk.

4. A wheel rim according to claim 1, wherein the outer edge portion of the disk subsequent to the bending operation includes a material accumulation which is arranged asymmetrically to a central plane extending centrally through the outer edge portion.

* * * * *